US007107796B1

(12) United States Patent
Jost

(10) Patent No.: US 7,107,796 B1
(45) Date of Patent: Sep. 19, 2006

(54) CRAFT NEEDLE WITH MEASURING CAPABILITIES AND METHOD OF USE OF SAME

(76) Inventor: Helen E. Jost, P.O. Box 113, Glen Spey, NY (US) 12737

( * ) Notice: Subject to any disclaimer, the term of this patent is extended or adjusted under 35 U.S.C. 154(b) by 0 days.

(21) Appl. No.: 11/217,874

(22) Filed: Sep. 1, 2005

(51) Int. Cl.
*D04B 3/00* (2006.01)

(52) U.S. Cl. ..... 66/1 A; 66/117

(58) Field of Classification Search ..... 66/1 A, 66/1 R, 116, 117, 118; 36/3 B, 17 R, 11
See application file for complete search history.

(56) References Cited

U.S. PATENT DOCUMENTS

| | | | | |
|---|---|---|---|---|
| 1,340,255 A | | 5/1920 | Schoolfield | |
| 2,187,039 A | * | 1/1940 | Kohler | 66/117 |
| 2,258,925 A | | 10/1941 | Burg | 66/117 |
| 2,378,544 A | | 6/1945 | Fosse et al. | 66/117 |
| 2,748,582 A | | 6/1956 | Hadler | 66/117 |
| D404,907 S | * | 2/1999 | Vicente | D3/28 |

* cited by examiner

*Primary Examiner*—Danny Worrell
(74) *Attorney, Agent, or Firm*—Sandra M. Kotin

(57) ABSTRACT

A craft needle having a measuring scale permanently applied along the longitudinal surface is disclosed. The zero point of the measuring scale is the distal end of the craft needle. The proximal end of the needle being the pointed end of a knitting needle and the hooked end of a crochet needle. Both knitting needles and crochet needles can be made with this feature. The length of a knitted work-piece can be measured by holding the distal end of the free needle vertically so the distal end is against the needle holding the work-piece and reading the length from the scale on the free needle. The width of a knitted work-piece and the dimensions of a crocheted work-piece can be measured by placing the distal end of the needle at one edge of the work-piece with the needle being parallel to the dimension being measured and reading the measurement from the scale on the needle. More than one measuring scale can be applied to a single needle with the zero points on all scales being at the distal ends of the needles.

7 Claims, 4 Drawing Sheets

45

CRAFT NEEDLE WITH MEASURING CAPABILITIES AND METHOD OF USE OF SAME

FIELD OF THE INVENTION

The instant invention relates to craft needles with measuring scales strategically placed thereon for use in measuring the dimensions of the work-pieces, and methods of use of same.

BACKGROUND OF THE INVENTION

The arts and crafts of knitting and crocheting are quite old. Knitting needles have not changed much since the earliest evidence of the technique was disclosed. Knitting needles come in different lengths and diameters and are made of a variety of materials. For the most part the only embellishment lies in the shape and size of the heads of the knitting needles. Crochet needles or hooks have not exhibited any embellishments.

During the fabrication of a knitted article it is often necessary to measure the work-piece before altering the stitch pattern or the shape of the work-piece. The knitter had to have a measuring tape or rule handy at all times so as not to have to stop work to locate one when a measurement had to be made. Crochet work-pieces fabricated in one piece or in several large pieces also require frequent measurements. Schoolfield tried to remedy this situation by disclosing the application of a measuring scale to the surface of the knitting needle. She also described a hollow needle composed of a transparent material and a measuring scale applied to a central core. The central core was inserted into the hollow needle and was visible through the transparent material. The zero point of the scale was located at the junction between the head and the shaft of the needle. (U.S. Pat. No. 1,340,255)

Burg, in U.S. Pat. No. 2,258,925, developed a knitting needle having a reduced area along one side. The needle could be inserted into an arcuate element with a hollow pointed bottom portion. The element could be riveted to the needle near the head forming a permanent bond between the two parts. Graduations on the element beginning below the head provided a measuring scale on the side of the needle.

In U.S. Pat. No. 2,378,544, Fosse et al. discloses a knitting needle with a measuring scale on the shaft. Also disclosed is a transparent needle with a hollow core and a slidable core stem containing a measuring scale. The zero point of the scale was located near the pointed end of the needle. The scale was enhanced by the use of different colors and phosphorescence for visibility in limited light.

Hadler (U.S. Pat. No. 2,748,582) teaches a knitting needle with a measuring scale on the surface of the needle and specifies that the zero point be located at the base of the cone forming the point of the needle. In addition to the measuring scale, the needle exhibits one or more additional scales representing the number of stitches per unit of measure formed with different thicknesses of yarn. The knitter need only move the work-piece to the zero point of the appropriate scale to know how many stitches are held on the needle. The scales could be etched on the surface of the needle or applied with curved members that fit into depressions on the surface of the needle shaft. The head of the needle is threaded and can be removed and replaced with an extension that increases the length of the needle.

Though all of the needles containing measuring scales could be helpful to the crafter, it is necessary to position the needle so the zero point is contiguous with one edge of the work-piece while making sure that the work-piece is lying flat. Some of the prior art needles have the zero point near the head and some near the pointed end of the needle. None of the prior art needles place the zero point of the measuring scale at the very end of the needle to facilitate making the necessary measurements.

There is a need for knitting needles and other craft needles such as crochet hooks to have measuring scales on their surfaces placed so that the zero points of the scales are at the ends of the needles.

BRIEF SUMMARY OF THE INVENTION

The present invention provides craft needles with one or more measuring scale permanently applied to their surfaces and having the zero points of the measuring scales at one end of the needles.

It is an object of the present invention to provide a craft needle with a measuring scale permanently displayed on its surface.

It is a further object of the present invention to provide a craft needle with a measuring scale on its surface and having the zero point at one end of the needle for ease of placement during measurement.

A still further object of the present invention is to provide a knitting needle with the zero point of the measuring scale at the distal end of the head of the knitting needle.

Another object of the present invention is to provide a knitting needle with a modified head to facilitate the measurement of the length of the work-piece.

A still further object of the present invention is to provide a method for accurately measuring the length and width of a work-piece using the needles according to the present invention.

The invention is a craft needle for use in the fabrication of a work-piece from a continuous filament. The needle comprises an elongated member substantially circular in cross section and having a proximal end and a distal end, and at least one measuring scale, taken from the group consisting of the metric scale and the English scale, permanently applied longitudinally to the surface of the elongated member, the at least one measuring scale having as its zero point one end of said elongated member and being marked in equidistant intervals numbered consecutively toward the opposing end. The craft needle may be used to measure the dimensions of the work-piece as it is being fabricated.

Also disclosed is a method for measuring the dimensions of a knitted work-piece during the fabrication thereof. The method comprises the steps of obtaining a pair of identical knitting needles, a first needle and a second needle, each of the needles comprising an elongated member substantially circular in cross section and having a proximal end and a distal end, the proximal end being substantially pointed, head means permanently disposed at the distal end of the elongated member, the head means being larger in circumference than the elongated member for preventing stitches held on the elongated member from sliding off the elongated member at its distal end, and at least one measuring scale permanently applied longitudinally to the surface of the elongated member, the at least one measuring scale having as its zero point the distal end of the head means and being marked in equidistant intervals numbered consecutively toward the proximal end. The method also includes obtaining necessary yarn and instructions to construct the work-piece, casting on the requisite number of stitches and proceeding to knit a portion of the work-piece, completing a row so that the first needle holds the entire work-piece and the second needle does not hold any stitches, spreading the work-piece evenly along the first needle maintaining the first needle in a horizontal orientation, holding the second needle in a vertical orientation with the proximal end pointed downward and bringing the distal end of the second needle upward to the first needle until the distal end of the head means touches the first needle and the second needle is adjacent to and parallel with a vertical edge the work-piece, and measuring the length of the work-piece using the at least one measuring scale on the second needle.

The invention is also a method for measuring the dimensions of a crocheted work-piece during the fabrication thereof. The method comprises the steps of obtaining a crochet needle, said needle comprising an elongated member substantially circular in cross section and having a proximal end and a distal end, the proximal end having a hook means for picking up and manipulating the yarn, at least one measuring scale permanently applied longitudinally to the surface of the elongated member, the at least one measuring scale having as its zero point the distal end of the crochet needle and being marked in equidistant intervals numbered consecutively toward the proximal end, and enlarging the loop of the last stitch completed and removing the crochet needle from the work-piece. The method also includes laying the work-piece on a flat surface and making sure that there are no wrinkles or folds in the work-piece, placing the crochet needle atop the work-piece so that the distal end is contiguous with a first edge of the work-piece and the crochet needle lies parallel to a first dimension being measured, and measuring the first dimension of the work-piece using the at least one measuring scale on the crochet needle.

The invention includes a craft needle for use in the fabrication of a work-piece from a continuous filament which comprises an elongated member substantially circular in cross section and having a proximal end and a distal end and at least one measuring scale, taken from the group consisting of the metric scale and the English scale, that is permanently applied longitudinally to the surface of the elongated member. The at least one measuring scale has as its zero point, one end of the elongated member and being marked in equidistant intervals numbered consecutively toward the opposing end. There is head means permanently disposed at the distal end of the elongated member. The head means being larger in circumference than the elongated member for preventing stitches held on the craft needle from sliding off the needle at the distal end. There is a depression in the distal surface of the head means, the depression conforming to the shape of the elongated member and capable of receiving the elongated member, and the low point of the depression representing the zero point of the at least one measuring scale. The craft needle may be used to measure the dimensions of the work-piece as it is being fabricated.

Other features and advantages of the invention will be seen from the following description and drawings.

DETAILED DESCRIPTION OF THE INVENTION

Figure 1:
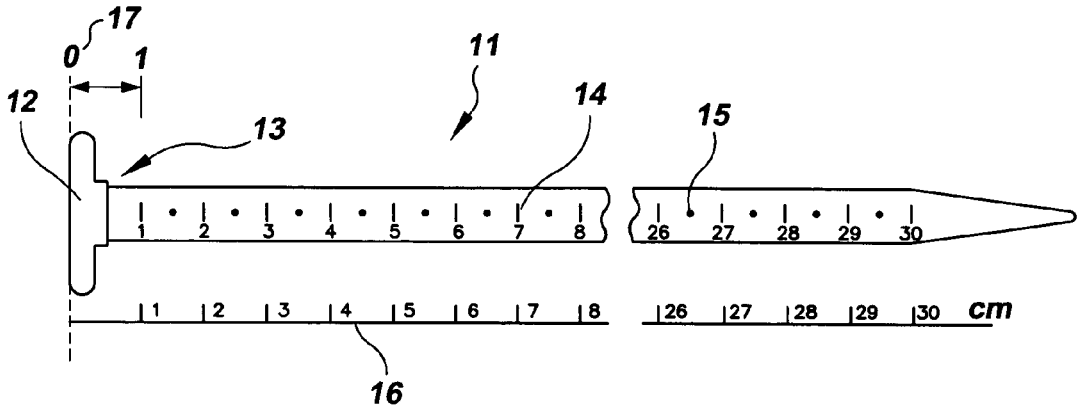
FIG. 1 is a fragmentary side elevational view of a knitting needle of the present invention.

A knitting needle 11 with a flat head 12 at its distal end 13 may be seen in FIG. 1. This knitting needle 11 may have a measuring scale disposed along its longitudinal surface. The measuring scale seen in FIG. 1 may be a metric scale marked in centimeters 14, with half centimeters indicated by additional markings 15. An external metric rule 16 may be seen adjacent the knitting needle 11. The zero point 17 of the scale on the knitting needle 11 may be the distal surface of the flat head 12.

Figure 2:
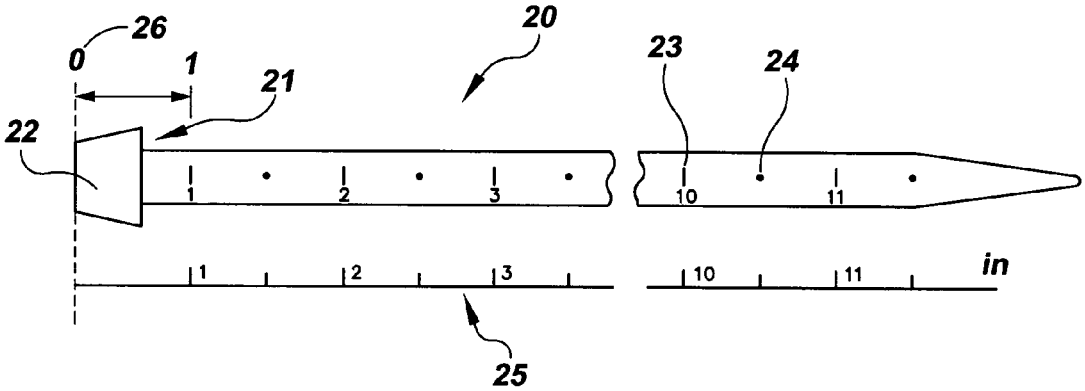
FIG. 2 is a fragmentary side elevational view of another knitting needle of the present invention.

A second knitting needle 20 may be seen in FIG. 2. This second knitting needle 20 may have the head 22 at its distal end 21 in the shape of a truncated pyramid. The second knitting needle 20 may have a measuring scale disposed along its longitudinal surface with the scale marked off in inches 23 and with additional markings to indicate the half inch 24. An external rule 25 marked in inches may be seen adjacent this knitting needle 20. Additional markings for the quarter inch and eighth inch may also be added but are not illustrated. The zero point 26 may be the flat distal surface of the head 22.

Figure 3:
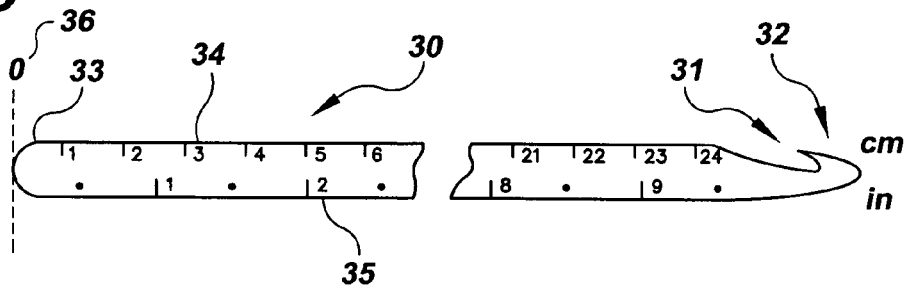
FIG. 3 is a fragmentary side elevational view of a afghan crochet hook of the present invention.
Figure 4:
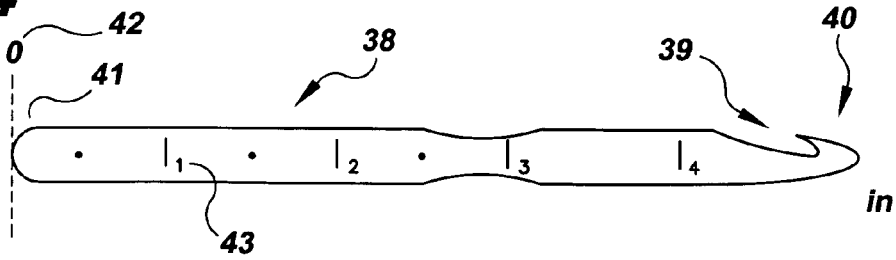
FIG. 4 is a side elevational view of a crochet hook of the present invention.

Other needle crafts such as crochet may also necessitate measuring a work-piece as the work progresses. To facilitate these measurements, crochet needles or hooks may also have measuring scales applied along their longitudinal surfaces. FIG. 3 is illustrative of a typical needle used in executing the afghan stitch, also known as Tunisian crochet. The afghan needle 30 may often be as long a knitting needle, but with a hook 31 at the proximal end 32 and a flat or rounded distal end 33. There may usually be no head. The afghan needle 30 illustrated may have two measuring scales permanently displayed on its longitudinal surface, the metric scale 34 and the English scale 35. The zero point 36 of both measuring scales may be situated at the distal end 33 and both measuring scales may be applied accordingly. The more common shorter crochet hook 38 may be seen in FIG. 4. There may be a hook 39 at the proximal end 40 and a flat or slightly rounded distal end 41. Even this short crochet hook 38 may have a measuring scale 43 disposed along its longitudinal surface. Again, the zero point 42 may be at the distal end 41 with the scale applied accordingly.

All of the above-described craft needles provide a handy measure for use in the course of fabricating a work-piece. To measure a work-piece, the work-piece may be laid out on a flat surface. The needle may be placed over the work-piece so the scale may be parallel to the dimension to be measured and so that the distal end of the needle is even with one edge of the work-piece. The length or width of the work-piece may be read directly from the scale on the needle.

Figure 5:
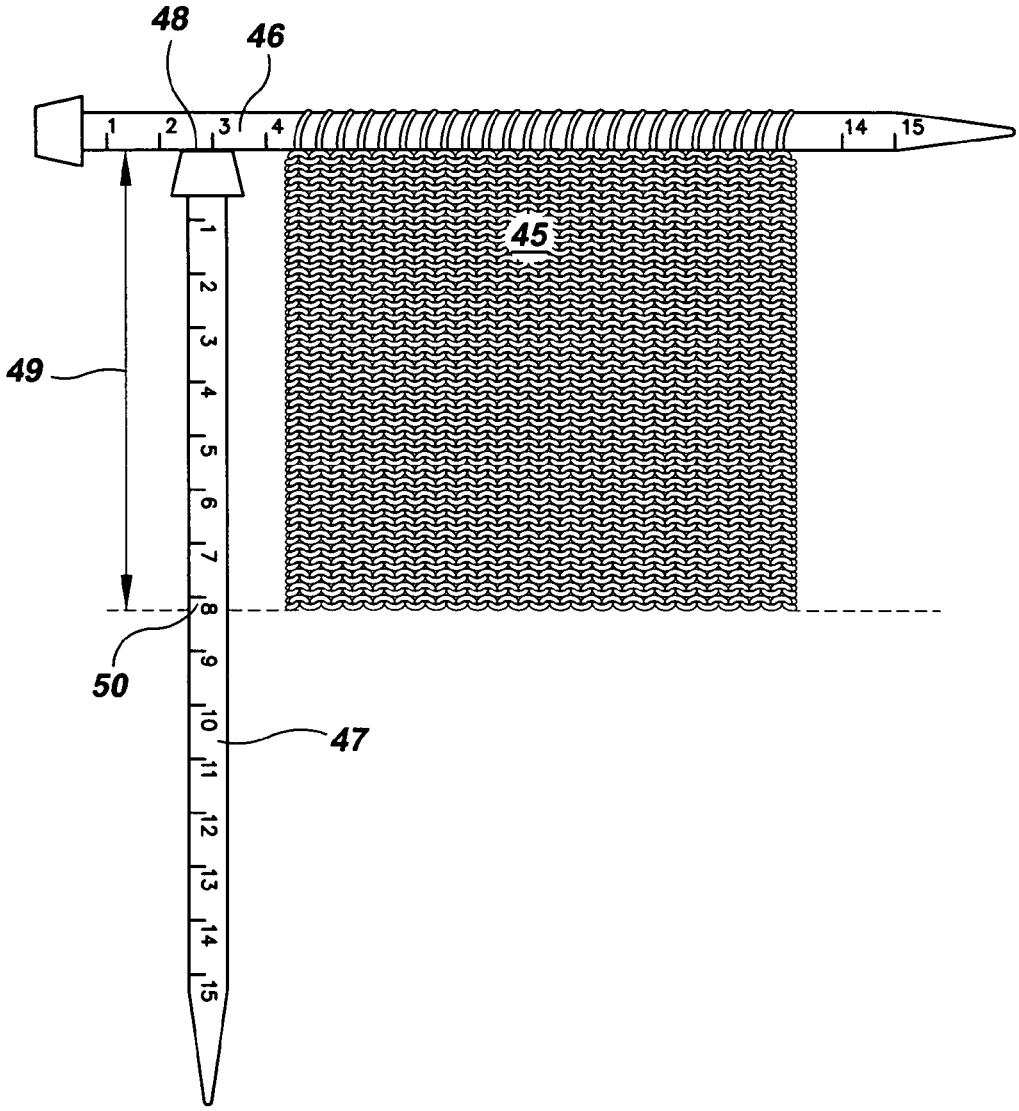
FIG. 5 is an elevational view illustrating a method for measuring the length of a work-piece using knitting needles according to the present invention.

If the work-piece is being fabricated by knitting, measurements may be made while the work-piece is on the needle. To measure the length of a knitted work-piece 45, the work-piece 45 may be spread out evenly along the first needle 46, the one holding the work-piece 45, and the first needle 46 may be extended horizontally. The second needle 47 may be disposed so that its distal end 48 may be placed up against the surface of the first needle 46 and the shaft may be held parallel to the work-piece and extended vertically downward. The exact length 49 of the work-piece 45 may easily be read from the scale 50 on the second needle 47. This may be seen in FIG. 5.

The zero point of the measuring scale may also be placed at the pointed end of a knitting needle, but this may make it more difficult to set the measuring needle (the second needle 47) against the holding needle (the first needle 46) when measuring the length of a work-piece. Since the pointed end is considerably narrower than the head end of a knitting needle, it may also be easier to set the head end at the edge of work-piece when measuring its width. Crochet needles may have the hook end with the pointed tip at the proximal end and it may also be advantageous when taking measurements with a scaled crochet needle according to the present invention to have the zero point at the distal end.

Figure 6:
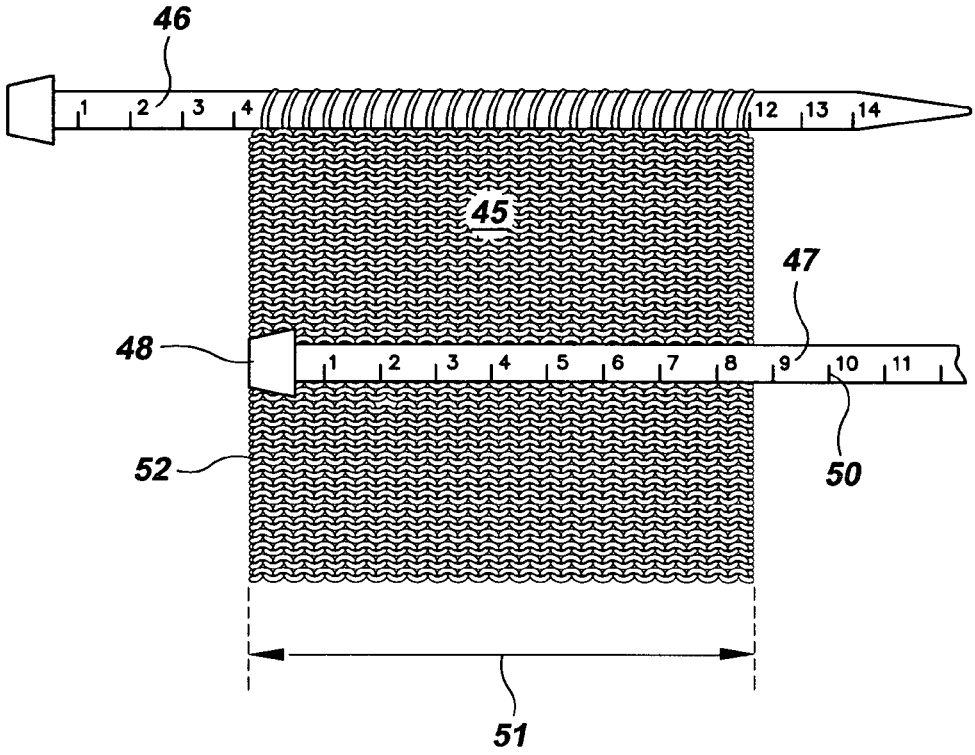
FIG. 6 is an elevational view illustrating a method for measuring the width of a work-piece using knitting needles according to the present invention.

The width 51 of a knitted work-piece 45 may be determined in two ways. In the first method, the work-piece 45 may be spread out evenly along the first needle 46 which may be held out horizontally as before, or it may be evenly spread out on a flat surface. The second needle 47 may then be held against the work-piece parallel to the dimension to be measured with its distal end 48 contiguous with one vertical edge 52 of the work-piece 45 and the width 51 read Directly from the scale 50. This method may be seen in FIG. 6. Both length and width of crochet work-pieces may be measured this way as long as the work-piece is evenly spread out on a flat surface. In crochet there is only one needle used and that needle can be completely removed from the work-piece without losing stitches. Therefore it may be easy to use a scaled crochet needle to make the necessary measurements.

For the second method of measuring the width of a knitted workpiece, the work-piece 45 may be spread out evenly along the horizontally held first needle 46 as before, but one vertical edge 52 of the work-piece 45 may be placed on a specific scale marker 54 (A) near the distal end 57 of the first needle 46. The width 51 may then be determined by noting the scale marker 56 nearest the opposing vertical edge 55 of the work-piece and subtracting the first reading (A) from the second reading (B):

$$B-A=\text{width of the work-piece}$$

Figure 7:
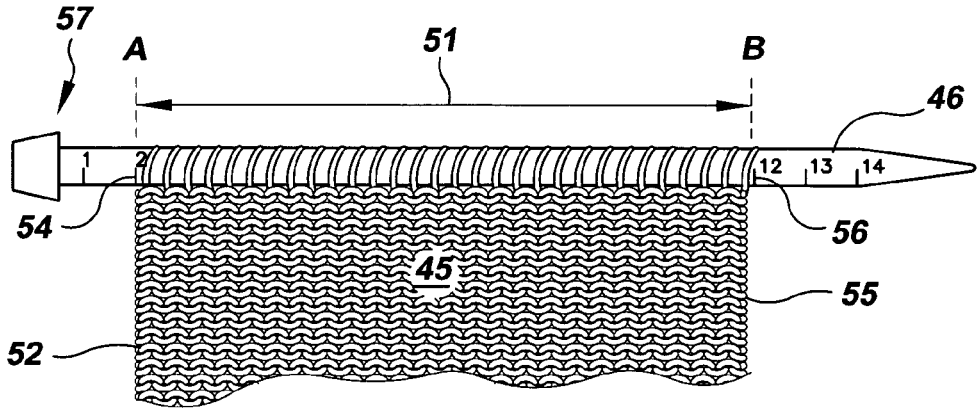
FIG. 7 is an elevational view illustrating another method for measuring the width of a work-piece using knitting needles according to the present invention.

This method may be seen in FIG. 7.

Figure 8:
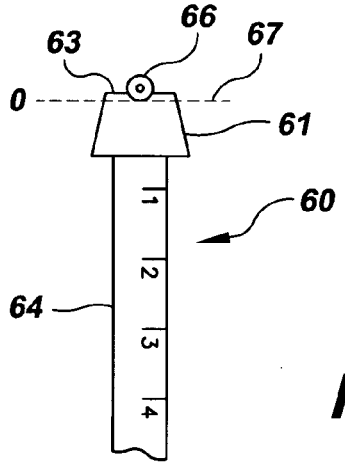
FIG. 8 is an end view of a second knitting needle and the modified head of a first knitting needle according to the present invention.
Figure 10:
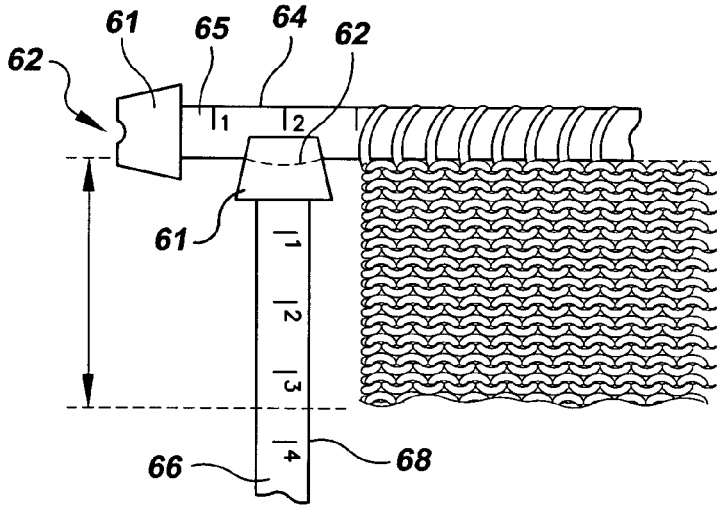
FIG. 10 is an elevational view of the method for measuring the length of a work-piece using knitting needles having the modified head of FIG. 8.
Figure 9:
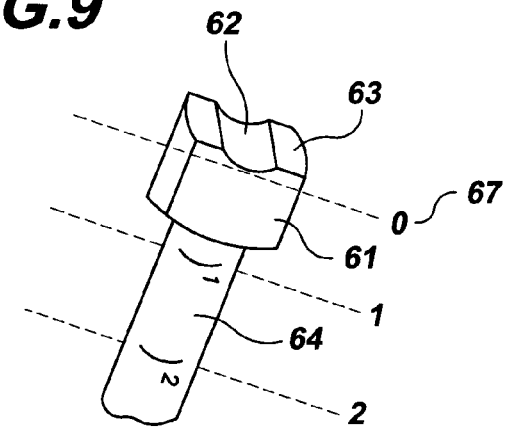
FIG. 9 is a perspective view of the modified head of FIG. 8.

In most needle crafted work-pieces, it may be the length that must be monitored during fabrication to determine when to change a stitch pattern, when to increase or decrease the number of stitches, or when to bind off. This may be most important for knitted work-pieces. To make measuring the length of the work-piece even easier, a knitting needle 60 with a modified head 61 may be used. The modification of the head may consist of a depression 62 in the distal surface or end 63 of the head 61. This depression 62 may conform to the contour of the shaft 64 of the needle 60. See FIG. 9. The bottom of the depression 62 may represent the zero point 67 for the needle 60 with the modified head 61. When measuring the length of the work-piece, the work-piece 45 may be spread out evenly along the first needle 65, the one holding the work-piece 45. The second needle 66 may be held vertically and the head 61 moved toward the shaft 64 of the first needle 65 until the shaft 64 rests within the depression 62 in the head 61 of the second needle 66. This may securely seat the second needle 66 against the shaft 64 of the first needle 65 to insure that the measurement may be accurate. The length of the work-piece may then be read from the scale 68 on the vertically held second needle 66 and the crafter need not be concerned that the second needle 66 might move while the measurement is being made. See FIGS. 8 and 10.

A knitting needle conforming to the present invention may have a head that may be flat, frusto-conical, in the shape of a truncated pyramid, or may have some other shape. The head may also be a whimsical sculptured design. The measuring scale may be metric or English, or both may be displayed on the same needle. Whatever the conformation of the head, the measuring scale applied to the longitudinal surface of the needle shaft may be applied in such a manner that the zero point is represented by the extreme distal end of the head and the scale markings must be set and numbered accordingly.

The craft needles described herein may be made of any rigid material such as, but not limited to metal, plastic, other polymeric material or wood. The heads and shafts of the knitting needles may be of singular construction, or they may be separate pieces that are permanently joined by methods well known in the art. The measuring scales placed on the knitting needles and other craft needles may be etched into the material of the shafts or may be applied by any method known in the art that provides a lasting image.

While several embodiments of the present invention have been illustrated and described in detail, it is to be understood that this invention is not limited thereto and may be otherwise practiced within the scope of the following claims.

I claim:

1. A method for measuring the dimensions of a knitted work-piece during the fabrication thereof, said method comprising the steps of:

obtaining a pair of identical knitting needles, a first needle and a second needle, each of said needles comprising an elongated member substantially circular in cross section and having a proximal end and a distal end, the proximal end being substantially pointed; head means permanently disposed at the distal end of the elongated member, said head means being larger in circumference than the elongated member for preventing stitches held on the elongated member from sliding off the elongated member at its distal end; at least one measuring scale permanently applied longitudinally to the surface of the elongated member, said at least one measuring scale having as its zero point the distal end of the head means and being marked in equidistant intervals numbered consecutively toward the proximal end;

obtaining necessary yarn and instructions to construct the work-piece;

casting on the requisite number of stitches and proceeding to knit a portion of the work-piece;

completing a row so that the first needle holds the entire work-piece and the second needle does not hold any stitches;

spreading the work-piece evenly along the first needle;

maintaining the first needle in a horizontal orientation;

holding the second needle in a vertical orientation with the proximal end pointed downward and bringing the distal end of the second needle upward to the first needle until the distal end of the head means touches the first needle and the second needle is adjacent to and parallel with a vertical edge the work-piece; and measuring the length of the work-piece using the at least one measuring scale on the second needle.

2. A method for measuring the dimensions of a knitted work-piece as in claim 1 further comprising the steps of:

making sure that the work-piece is evenly distributed along the first needle;

holding the second needle horizontally adjacent to the work-piece so that the distal end of the head means is contiguous with one edge of the work-piece and measuring the width of the work-piece using the at least one measuring scale on the second needle.

3. A method for measuring the dimensions of a knitted work-piece as in claim 1 further comprising the steps of:

making sure that the work-piece is evenly distributed along the first needle and setting one end of the work-piece on one of the numbered intervals on the at least one measuring scale;

noting the number of the interval, this being a first reading;

noting the number of the interval closest to the opposing end of the work-piece, this being a second reading;

subtracting the first reading from the second reading to obtain the width of the work-piece.

4. A craft needle for use in the fabrication of a work-piece from a continuous filament, said needle comprising:

an elongated member substantially circular in cross section and having a proximal end and a distal end; and at least one measuring scale, taken from the group consisting of the metric scale and the English scale, permanently applied longitudinally to the surface of the elongated member, said at least one measuring scale having as its zero point one end of said elongated member and being marked in equidistant intervals numbered consecutively toward the opposing end, head means permanently disposed at the distal end of the elongated member, said bead means being larger in circumference than the elongated member for preventing stitches held on the craft needle from sliding off the needle at the distal end;

a depression in the distal surface of the head means, said depression conforming to the shape of the elongated member and capable of receiving the elongated member, and the low point of said depression representing the zero point of the at least one measuring scale, whereby the craft needle may be used to measure the dimensions of the work-piece as it is being fabricated.

5. A craft needle as in claim 4 further comprising at least one additional measuring scale the zero point of which being contiguous with the first zero point.

6. A pair of identical knitting needles for use in the fabrication of a work-piece from a continuous filament, each needle comprising:

an elongated member substantially circular in cross section and having a proximal end and a distal end;

head means permanently disposed at the distal end of the elongated member, said head means being larger in circumference than the elongated member for preventing stitches held on the elongated member from sliding off the elongated member at the distal end; and at least one measuring scale permanently applied longitudinally to the surface of the elongated member, said at least one measuring scale having as its zero point the distal end of the head means and being marked in equidistant intervals numbered consecutively toward the proximal end;

whereby the knitting needles may be used to measure the length and width of the work-piece as it is being fabricated.

7. A pair of knitting needles as in claim 6 wherein the head means is in the form of a sculptured design.

* * * * *